US005197168A

United States Patent [19]

Levy

[11] Patent Number: 5,197,168

[45] Date of Patent: * Mar. 30, 1993

[54] MAGNETIC JEWELRY CLOSURES WITH WIRE SAFETY CLASP

[76] Inventor: Davida Levy, 1340 Biscaya Dr., Surfside, Fla. 33154

[ * ] Notice: The portion of the term of this patent subsequent to Apr. 23, 2008 has been disclaimed.

[21] Appl. No.: 818,266

[22] Filed: Jan. 8, 1992

Related U.S. Application Data

[63] Continuation-in-part of Ser. No. 688,102, Apr. 19, 1991, Pat. No. 5,092,019, which is a continuation-in-part of Ser. No. 536,777, Jun. 12, 1990, Pat. No. 5,008,984.

[51] Int. Cl.[5] ..... A44B 11/25

[52] U.S. Cl. ..... 24/303; 24/616

[58] Field of Search ..... 24/303, 616, 615, 618, 24/49 M, 94, 688, 116 A, 626, 283; 63/2, 4; 292/251.5; 248/206.5

[56] References Cited

U.S. PATENT DOCUMENTS

| | | | |
|---|---|---|---|
| 468,677 | 2/1892 | Maxheimer et al. | 24/616 |
| 807,069 | 12/1905 | Geoffroy . | |
| 1,320,486 | 11/1919 | Maxim et al. | 24/626 |
| 1,807,293 | 5/1931 | Keller | 24/616 |
| 2,173,818 | 9/1939 | Baumer | 24/626 |
| 2,178,572 | 11/1939 | Forstner | 24/616 |
| 2,623,256 | 12/1952 | Feibelman | 24/303 |
| 2,648,884 | 8/1953 | Loofboro | 24/303 |
| 2,654,929 | 10/1953 | Feibelman . | |
| 2,901,278 | 8/1959 | Robinson | 292/251.5 |
| 3,041,697 | 7/1962 | Budreck . | |
| 3,111,736 | 11/1963 | Budreck . | |
| 3,129,477 | 4/1964 | Mizuno | 24/303 |
| 3,192,747 | 7/1965 | Stupell et al. | 24/303 |
| 3,621,690 | 11/1971 | Whitcomb | 24/303 |
| 3,897,288 | 7/1975 | Fayling . | |
| 4,170,809 | 10/1979 | Geldwerth et al. . | |
| 4,231,137 | 11/1980 | Fujimoto | 24/303 |
| 4,426,854 | 1/1984 | Geldwerth et al. | 24/616 |
| 4,499,634 | 2/1985 | Bimmardi | 24/616 |
| 4,520,537 | 6/1985 | Valikov | 24/616 |
| 4,527,316 | 7/1985 | Murphy | 24/116 A |
| 4,530,221 | 7/1985 | Weinberg | 63/2 |
| 4,881,305 | 11/1989 | Rivera | 24/616 |
| 4,901,405 | 2/1990 | Grover et al. | 24/303 |
| 5,008,984 | 4/1991 | Levy | 24/303 |

*Primary Examiner*—Victor N. Sakran
*Attorney, Agent, or Firm*—Keck, Mahin & Cate

[57] ABSTRACT

A jewelry closure includes a pair of magnetic closure members for magnetically engaging together and a mechanical closure which acts as a second closure or safety feature. One or both closure members includes a magnet. The mechanical closure includes a substantially stiff wire member which pivots about a first member of the closure. An intermediate portion of the wire member is engaged adjacent an end face of the second member of the closure to prevent the magnetic members from being separated until after the wire member is pivoted to the open position. The mechanical closure must be released before the magnetic closure can be released. The jewelry closure includes an end ring on each member for attaching to jewelry. A spring ring closure may optionally be attached to each of these rings for attaching jewelry, such as a chain, to the magnetic closure. Using this feature, the magnetic closure may readily be used as a replacement clasp for jewelry.

16 Claims, 2 Drawing Sheets

MAGNETIC JEWELRY CLOSURES WITH WIRE SAFETY CLASP

RELATED APPLICATION

This application is a continuation-in-part of Ser. No. 688,102, filed Apr. 19, 1991, now U.S. Pat. No. 5,092,019, which is a continuation-in-part of Ser. No. 536,777, filed Jun. 12, 1990, now U.S. Pat. No. 5,008,984.

FIELD OF THE INVENTION

The invention relates to magnetic jewelry closures having a mechanical safety clasp.

BACKGROUND OF THE INVENTION

Known jewelry closures may be hard to close, particularly for young, elderly and/or disabled users. Known magnetic closures are shown in Mizuno, U.S. Pat. No. 3,129,477, which discloses jewelry closures and in Budreck, U.S. Pat. Nos. 3,041,697 and 3,111,736, which discloses magnetic keyring closures. Particularly when used for heavy or valuable jewelry, there may be a perceived lack of strength of the magnetic closure due to the absence of a safety closure in addition to the magnetic closure.

Other patents also describe jewelry closures. Geoffroy, U.S. Pat. No. 807,069, describes an automatic fastening device having a mechanically engaged clip. Keller, U.S. Pat. No. 1,807,293, describes a jewelry fastener having a hinged safety clip attached to a first closure member. When the second closure member is engaged within the first closure member, the hinged clip fastens through aligned apertures in intermediate positions of the first and second casing members. Forstner, U.S. Pat. No. 2,178,572, describes a sheet metal wrist watch closure in which a second member snaps into a first member and a pivoted member attached to the first member snaps over a roll on the second member.

Feibelman, U.S. Pat. No. 2,623,256, describes a magnetic jewelry connector alone, without a combined mechanical closure. Loofboro, U.S. Pat. No. 2,648,884, describes a magnetic jewelry clasp having mechanically interlocking shapes. The magnetic and mechanical engagement of the two halves are released at the same time. Feibelman, U.S. Pat. No. 2,654,929, describes a magnetic box-type closure for a bracelet. Raising the finger tab provided breaks the magnetic engagement. Robinson, U.S. Pat. No. 2,901,278, describes a magnetic latch assembly for closing a door. Fayling, U.S. Pat. No. 3,897,288, describes polymer-based magnets for forming magnetic fasteners. Geldwerth, et al., U.S. Pat. No. 4,170,809, describes a jewelry clasp having a jewel mechanical closure. The safety closure includes a wire member having a hook for releasably snapping over a pin having an enlarged head. Rivera, U.S. Pat. No. 4,881,305, describes an improved locking box clasp for jewelry in which a hinged member is inserted through a sidewall of the first closure member to which the clip is hinged, and is subsequently retained between two members of a locking box, preventing inadvertent compression of the locking box and thus preventing inadvertent removal of the clip member from the box.

None of these patents discloses or suggests the combination of a magnetic closure with a simple wire safety clasp in which the safety clasp must be opened before the two parts of the magnetic clasp can be separated.

SUMMARY OF THE INVENTION

A clasp or closure of the invention for jewelry, such as necklaces, bracelets and anklets, and for hair accessories, such as pony tail holders, and for belts and other clothing accessories, includes a pair of magnetic closure members for magnetically engaging together to join the ends of the jewelry or other item to be closed. One or both closure members may include a magnet. The first closure member is supported in a casing which extends outwardly to receive the second closure member, enabling the two closure members to be magnetically engaged together. After magnetic engagement, the members are then mechanically engaged together, providing a second closure which operates as a safety feature for the jewelry clasp. Thus, the closure includes a mechanical means of engagement which acts as a safety feature in addition to the initial magnetic engagement of the two parts. The mechanical closure must be released before the magnetic closure can be released.

A preferred mechanical safety closure is a safety device of substantially stiff spring wire having first and second ends which pivotally engage the first closure member. An intermediate portion of the wire is pivoted about the first closure member and engages an outer end surface of the second closure member.

It is an object of the invention to provide a magnetic jewelry closure including a magnetic closure and a mechanical closure which acts as a safety feature to prevent ready separation of the magnetic closure.

It is another object of the invention to provide a magnetic jewelry closure including a magnetic closure and a substantially stiff wire closure which pivots from an open position to a closed position to prevent separation of the magnetic closure until after the wire closure is opened.

DETAILED DESCRIPTION OF THE INVENTION

This application is a continuation-in-part of U.S. patent application, Ser. No. 688,102, filed Sep. 24, 1991, which is a continuation-in-part of U.S. patent application, Ser. No. 536,777, filed Jun. 12, 1990, now U.S. Pat. No. 5,008,984. The entire disclosures of these applications are incorporated herein by reference.

The invention is a jewelry closure or clasp in which first and second closure members are attracted together by magnetic forces. The closure is secured by a mechanical safety device which holds the closure firmly secured until positive force is applied to release the safety device and open the magnetic closure. The safety closure prevents the first and second magnetic members from being accidentally separated from each other.

The magnets in the closure may be iron magnets or may be rare earth magnets such as sumerian cobalt or neodymium magnets. One or both of the closure members includes a magnet. If only one member includes a magnet, the other member includes material attracted by the magnetic member. If both members include magnets, both magnets may be of the same type or of different types as long as the members are magnetically attracted together. The appropriate choice of magnetic members will be apparent to one skilled in the art and may include more than one magnet in each closure member, for some purposes. Neodymium magnets may be preferred for extended retention of magnetism.

The mechanical closure is preferably a spring wire safety clasp which pivots on a first magnetic member of the closure and is received against an end face of the second magnetic member of the closure when both ends of the closure are magnetically engaged together.

A closure of the invention can be used to join any jewelry or clothing for which it is appropriate, and is particularly useful for closing necklaces, bracelets, anklets and belts. Closures may also be used for hair accessories, such as pony tail holders or other hair retainers. One member of the closure is carried by each end of the jewelry, article of clothing or hair retainer and the parts are joined magnetically by simply bringing the members together. The safety closure is engaged by pivoting the wire closure member engaged with the first magnetic member into engagement adjacent the second magnetic member to prevent withdrawal of the second magnetic member from the first magnetic member before opening the safety closure.

Due to the magnetic attraction between the first and second members of the closure, these members seek each other and even if the user is infirm or disabled, the jewelry may be closed effortlessly.

Figure 1:
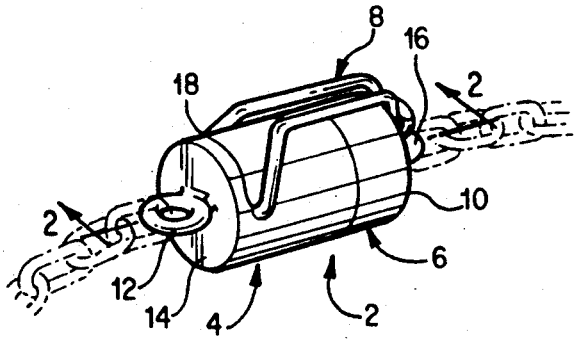
FIG. 1 is a perspective view of a closed magnetic and mechanical jewelry closure of the invention.

With reference to FIGS. 1 to 21, in which like numerals represent like elements, FIG. 1 illustrates cylindrical jewelry closure 2, having first closure member 4 and second closure member 6 engaged together magnetically. Wire clasp 8 is engaged against end face 10 of second closure member 6. Ring 12 is affixed to end face 14 of first closure member 4 for receiving one end of jewelry, such as a necklace, bracelet, anklet or other jewelry, belt or hair ornament to be fastened. Ring 16 is attached to end face 10 for receiving the other end of the jewelry or article to be fastened. Wire clasp 8 is engaged in apertures 18 in first closure member 4.

Wire clasp 8 is preferably a single piece of spring wire having a pair of ends 20 which engage in apertures 18 in first closure member 4. Wire clasp 8 is shown in side view in FIGS. 2 to 5 and in top view in FIG. 21. Each end of central portion 22 is attached to an upper end of a first leg 24 of a U-shaped portion 26 which extends downward from central portion 22. Upper ends 29 of second legs 28 of U-shaped portion 26 are each connected to one end of a straight portion 30. Straight portions 30 are substantially parallel to each other and rest on top of jewelry closure 2 when in closed position. Other ends of straight portion 30 are each connected to portions 32 which are angled downward to connect to ends 20 inserted into apertures 18 in first closure member 4 of jewelry closure 2. Second legs 28 rest against end surface 33 of second closure member 6 when jewelry closure 2 is closed.

Figure 21:
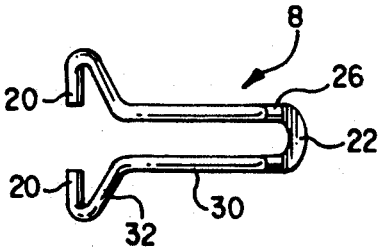
FIG. 21 is a top view of a wire member useful for practising the invention.

FIG. 21 illustrates a non-limiting example of wire safety clasp 8. Other shapes of wire clasp 8 which perform the safety clasp function of pivoting on one member of the jewelry closure and preventing the other member from being withdrawn until the wire clasp is released, will be apparent to those skilled in the art.

Figure 2:
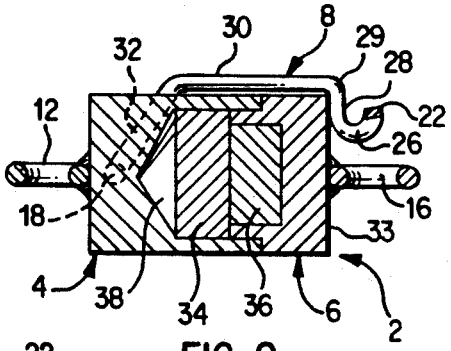
FIG. 2 is a cross-sectional view taken on line 2—2 of FIG. 1.
Figure 3:
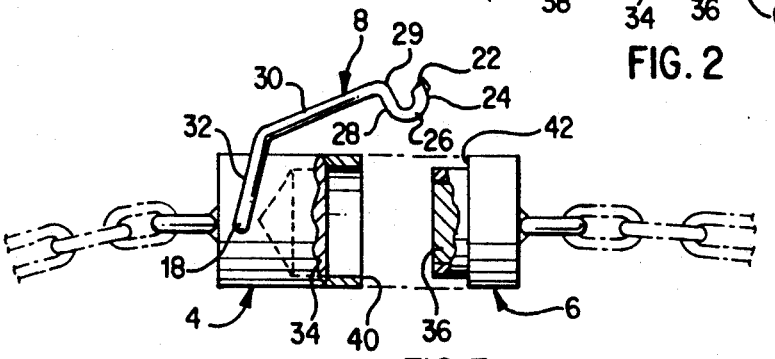
FIG. 3 is an elevational view, partly in cross-section, of an open magnetic and mechanical jewelry closure of FIG. 1.

FIG. 2 shows jewelry closure 2 in cross-section. First closure member 4 holds first magnet 34 and second closure member 6 holds second magnet 36. First magnet 34 is held in aperture 38 in an appropriate position to receive second closure member 6 including second magnet 36 in magnetic engagement therewith when jewelry closure 2 is closed, as shown in FIG. 2. FIG. 3 shows the jewelry closure of FIGS. 1 and 2 in open position. FIG. 3 clearly shows end 40 of first closure member 4 which rests against ledge 42 on second closure member 6 when jewelry closure 2 is fastened, as shown in FIGS. 1 and 2. FIG. 3 also shows wire clasp 8 pivoted upward in apertures 18 when jewelry closure 2 is opened.

Figure 4:
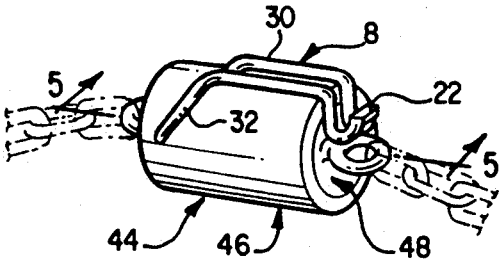
FIG. 4 is a perspective view of another closed magnetic and mechanical jewelry closure of the invention.
Figure 5:
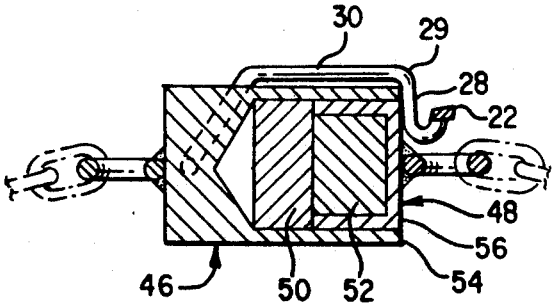
FIG. 5 is a cross-sectional view taken on line 5—5 of FIG. 4.
Figure 6:
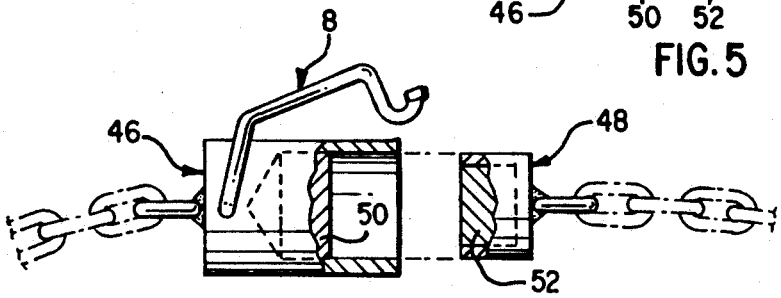
FIG. 6 is an elevational view, partly in cross-section, of an open magnetic and mechanical closure of FIG. 4.

FIGS. 4 to 6 illustrate another embodiment of the jewelry closure using the same wire clasp. Jewelry closure 44 has first closure member 46 which fits into second closure member 48. As shown in FIG. 5, first magnet 50 is held by first closure member 46 and second magnet 52 is held by second closure member 48. Second closure member 48 fits into first closure member 46 so that end surface 54 of first closure member 46 is substantially coplanar with end surface 56 of second closure member 48 when jewelry closure 44 is closed. Second leg member 28 of wire clasp 8 rests against surfaces 54 and 56 when jewelry closure 44 is closed. FIG. 6 shows the closure of FIGS. 4 and 5 in open position with wire clasp 8 pivoted upwardly to allow second closure member 48 to be withdrawn from first closure member 46.

Figure 7:
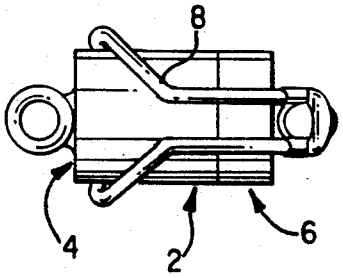
FIG. 7 is a top view of the closure of FIG. 1.

FIG. 7 illustrates a top view of the closure of FIGS. 1 and 2, clearly showing the position of wire clasp member 8 when jewelry closure 2 is closed.

Figure 8:
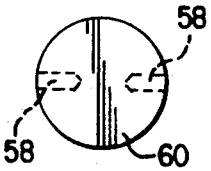
FIG. 8 is a schematic end elevational view of a pair of channels for receiving ends of a wire safety closure.
Figure 9:
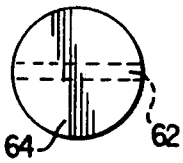
FIG. 9 is a schematic end elevational view of a single channel for receiving ends of a wire safety closure.

FIGS. 8 and 9 show alternative embodiments of the channels in the first clasp member in which ends 20 of wire clasp 8 are inserted. FIG. 8 shows a pair of channells 58 drilled into a first closure member 60 in diametrically opposite positions. While diametrically opposite positions are preferred, the channels may be drilled at an angle to each other if the wire clasp is shaped appropriately, as will be apparent to one skilled in the art. In an alternative embodiment, shown in FIG. 9, a single channel 62 is drilled through a first closure member 64. The channel is preferably positioned substantially diametrically through the member but may be otherwise located.

FIGS. 10 to 13 illustrate another embodiment in which spring rings for attaching jewelry are attached to ends of the closure members in place of or in addition to rings 12 and 16 described above. Spring rings allow a user to attach and detach jewelry easily and safely, without need to leave jewelry with a jeweler. Spring rings are known in the art for use alone for closing jewelry, but this use for attaching jewelry is unexpectedly advantageous, as will be appreciated by the description herein.

Figure 10:
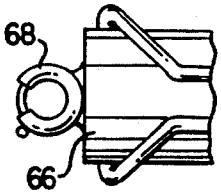
FIG. 10 is a partial top view of a closure of the invention showing a spring ring for engaging jewelry.
Figure 11:
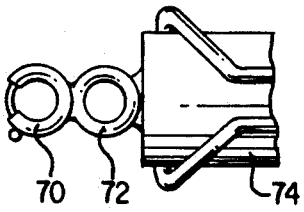
FIG. 11 is a partial top view of a closure of the invention showing a second arrangement of a spring ring for engaging jewelry.
Figure 12:
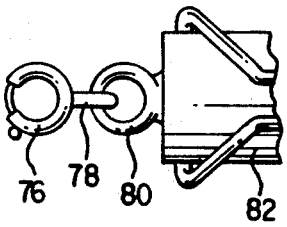
FIG. 12 is a partial top view of a closure of the invention showing a third arrangement of a spring ring for engaging jewelry.
Figure 13:
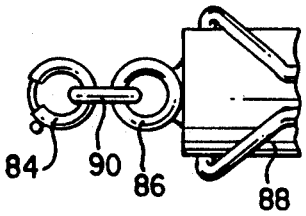
FIG. 13 is a partial top view of a closure of the invention showing a fourth arrangement of a spring ring for engaging jewelry.

FIG. 10 shows a typical closure member 66 having spring ring 68 attached thereto for attaching jewelry. A similar spring ring may be attached to the other closure member of the jewelry closure. In another embodiment, shown in FIG. 11, spring ring 70 is directly attached to simple ring 72 on closure member 74. FIG. 12 illustrates spring ring 76 having ring 78 attached perpendicularly thereto and ring 78 is fastened through ring 80 of closure member 82. FIG. 13 shows a further embodiment in which spring ring 84 is attached to ring 86 o closure member 88 by ring 90 passing therebetween. A spring ring may be attached to one or both closure members of a jewelry closure of the invention.

In a particularly useful and advantageous embodiment, a jewelry closure of the invention having a spring ring on one or both ends may be used to add a further clasp to a necklace or bracelet already having a clasp (which may or may not be a spring ring clasp). Particularly when users become elderly or frail, jewelry closures may be difficult to close. Since a magnetic closure of the invention is particularly easy to close and closes very securely, a clasp of the invention can be attached to a necklace or bracelet in addition to the clasp already present.

For example, if a necklace has a simple spring ring closure and a magnetic closure of the invention is preferred, the spring rings on the magnetic closure of the invention can be fastened to the spring ring of the necklace to effectively replace the clasp. If a magnetic closure of the invention has a simple ring on one member and a spring ring on the other member, a spring ring of a necklace can be fastened to the simple ring of the magnetic closure of the invention and the spring ring of the magnetic closure can be fastened to the simple ring of the necklace, thereby effectively replacing the clasp. Thus, a clasp of the invention is useful as a clasp on jewelry or as a replacement clasp.

Figure 14:
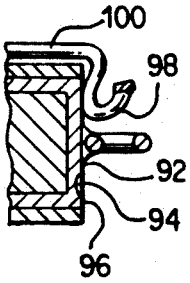
FIG. 14 is a partial cross-sectional view of an end of a jewelry closure showing the wire clasp engaged in an annular grrove in an end surface, of the clasp.
Figure 15:
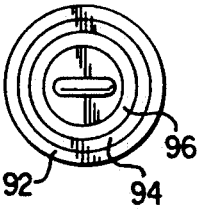
FIG. 15 is an end view of the clasp of FIG. 14 showing the annular groove in the end surface of the clasp.

FIGS. 14 to 20 illustrate further embodiments showing means for positioning the wire safety clasp adjacent the end surface of the second closure member. While the wire member rests securely in position without a separate catch, some users may prefer a positive catch for the wire safety member. FIGS. 14 and 15 illustrate an end closure of the type shown in FIGS. 4 to 6. Second closure member 92 includes an annular groove 94 in end surface 96 thereof. U-shaped portion 98 of wire clasp 100 rests in annular groove 94 when the jewelry closure is in closed position.

Figure 16:
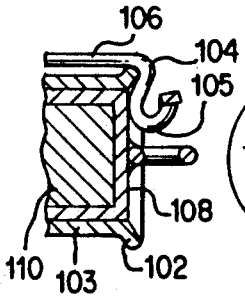
FIG. 16 is a partial cross-sectional view showing an annular lip around an end portion of a first member of the clasp.
Figure 17:
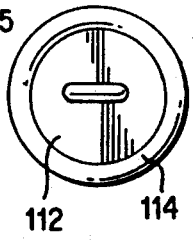
FIG. 17 is an end elevational view of the clasp of FIG. 16 with the wire member disengaged.
Figure 18:
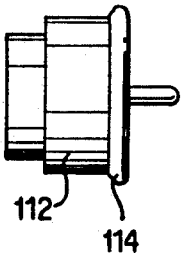
FIG. 18 is a side elevational view of a second member of another clasp showing an annular lip around the end portion thereof.
Figure 19:
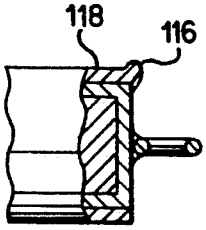
FIG. 19 is a side elevational view, partly in cross-section, showing a protrusion for retaining the wire member on a first member of the clasp.
Figure 20:
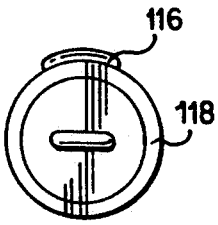
FIG. 20 is an end elevational view of the clasp of FIG. 19, with the wire member disengaged.

FIG. 16 illustrates another embodiment in which a lip 102 on the outer edge of first closure member 103 of a jewelry closure shown in FIGS. 4 to 6 catches upper end 104 of U-shaped portion 105 of wire clasp 106. U-shaped portion 105 rests against end 108 of second closure member 110. FIGS. 17 and 18 show a similar embodiment to that of FIG. 16, but adapted for a jewelry closure of FIGS. 1 to 3. Second closure member 112 has a lip 114 around the circumference thereof for retaining the wire clasp, as shown in FIG. 16. FIGS. 19 and 20 show another embodiment similar to FIG. 16, for a clasp of FIGS. 4 to 6 in which protruding lip 116 only extends from a portion of the circumference of first closure member 118. The wire clasp engages lip 116, as shown in FIG. 16.

The jewelry closure is preferably of circular cross-section, although an oval, square, rectangular or other appropriate shape may be used. A closure of the invention may be any size and shape as long as the first and second closure members are first joined magnetically and then joined mechanically to hold the attached decorative items in closed position. Other shapes for the jewelry closure will be apparent to those skilled in the art. The closures are not limited to the examples illustrated.

The closures described may be used with any type of jewelry, such as chains, strings of beads, or other jewelry. Various pieces of jewelry may be joined together, firmly and with great versatility, using these closures. The closures may also be used for clothing, belts, hair accessories or for other uses. The casings for the closures may be made of any appropriate material, such as metal or plastic. Metal is preferred for the wire safety closure, though plastic may be used if the plastic material satisfactorily prevents the magnetic closure members from being separated.

The closure may be color coordinated with the article being closed. If the closure casing is made of metal, it may be color toned with the jewelry or other article being closed. If the closure casing is made of plastic, it may, likewise, be color coordinated.

While the invention has been described above with respect to certain embodiments thereof, it will be appreciated that variations and modifications may be made without departing from the spirit and scope of the invention.

What is claimed is:

1. A jewelry closure comprising:

a magnetic closure comprising first and second closure members for engaging together magnetically, wherein at least one of said first and second closure members comprises a magnet;

a mechanical closure pivotally engaged with said first closure member for engaging adjacent said second closure member when said second closure member is held by magnetic attraction to said first closure member wherein said mechanical closure comprises a wire member pivotally engaged with said first closure member;

whereby said magnetic closure cannot be released until after said mechanical closure is released from engagement with said second closure member.

2. A jewelry closure according to claim 1 wherein said wire member comprises first and second ends engaged with said first closure member and an intermediate portion adapted for engaging adjacent said second closure member when said jewelry closure is in secured condition.

3. A jewelry closure according to claim 2 wherein said second closure member further comprises means for engaging said wire member when said jewelry closure is in secured position.

4. A jewelry closure according to claim 3 wherein said engaging means comprises a protrusion extending outward from said first closure member for engaging said wire member.

5. A jewelry closure according to claim 2 wherein said first and second ends are respectively pivotally engaged in first and second channels extending inward from an outer surface of said first closure member.

6. A jewelry closure according to claim 5 wherein said first and second channels extend inward from diametrically opposite positions on said outer surface of said first closure member.

7. A jewelry closure according to claim 2 wherein said first and second ends are respectively pivotally engaged in opposite ends of a channel extending transversely through said first closure member.

8. A jewelry closure according to claim 1 wherein said first and second closure members each include a magnet and said wire member is adapted for pivoting to engaged position adjacent said second closure member when said first and second closure members are magnetically engaged together.

9. A jewelry closure according to claim 1 wherein said at least one magnet comprises magnetic material selected from the group consisting of ferrous magnetic material and rare earth magnetic material.

10. A jewelry closure according to claim 1 wherein said at least one magnet comprises magnetic material selected from the group consisting of iron, sumerian cobalt and neodymium.

11. A jewelry closure according to claim 1 wherein said first closure member comprises a first casing, first and second channels in said first casing for receiving respective ends of said wire member and a first magnet and said second closure member comprises a second casing and a second magnet for engaging in magnetic contact with said first magnet, wherein said wire member is adapted for engagement adjacent said second casing when said magnetic members are engaged together magnetically.

12. A jewelry closure according to claim 11 wherein said first and second casings each comprise a ring engaged therewith for receiving ends of jewelry to be closed.

13. A jewelry closure according to claim 12 wherein at least one of said rings further comprises means engaged therewith for releasably receiving an end of jewelry to be closed.

14. A jewelry closure according to claim 13 wherein said means for releasably receiving an end of jewelry to be closed comprises a spring ring.

15. A jewelry closure according to claim 13 wherein each of said rings further comprises a spring ring for releasably receiving an end of jewelry to be closed.

16. A jewelry closure according to claim 12 wherein each of said rings further comprises a spring ring for releasably receiving an end of jewelry to be closed.

* * * * *